United States Patent [19]

Lacan

[11] 3,980,978

[45] Sept. 14, 1976

[54] ELECTROMAGNETIC RELAY

[75] Inventor: Guy Lacan, Carrieres-sous-Bois, France

[73] Assignee: La Telemecanique Electrique, France

[22] Filed: May 13, 1975

[21] Appl. No.: 577,126

[30] Foreign Application Priority Data

June 25, 1974 France ..... 74.22016

[52] U.S. Cl. ..... 335/132; 335/201

[51] Int. Cl.[2] ..... H01H 63/02

[58] Field of Search ..... 337/128, 132, 201, 202

[56] References Cited

FOREIGN PATENTS OR APPLICATIONS 1,527,178 5/1968 France

*Primary Examiner*—Donovan F. Duggan
*Assistant Examiner*—Fred E. Bell
*Attorney, Agent, or Firm*—William Anthony Drucker

[57] ABSTRACT

The present invention relates to a small electromagnetic relay comprising three independent sub-assemblies serving to fulfill respectively the function of motor, contact and connecting base and which can be assembled together.

The contact sub-assembly is formed by an arcing box having recesses serving to receive the contact supports held in place between the base and the motor.

The relay according to the present invention is applicable to automation and control circuits.

6 Claims, 4 Drawing Figures

ELECTROMAGNETIC RELAY

Figure 1:
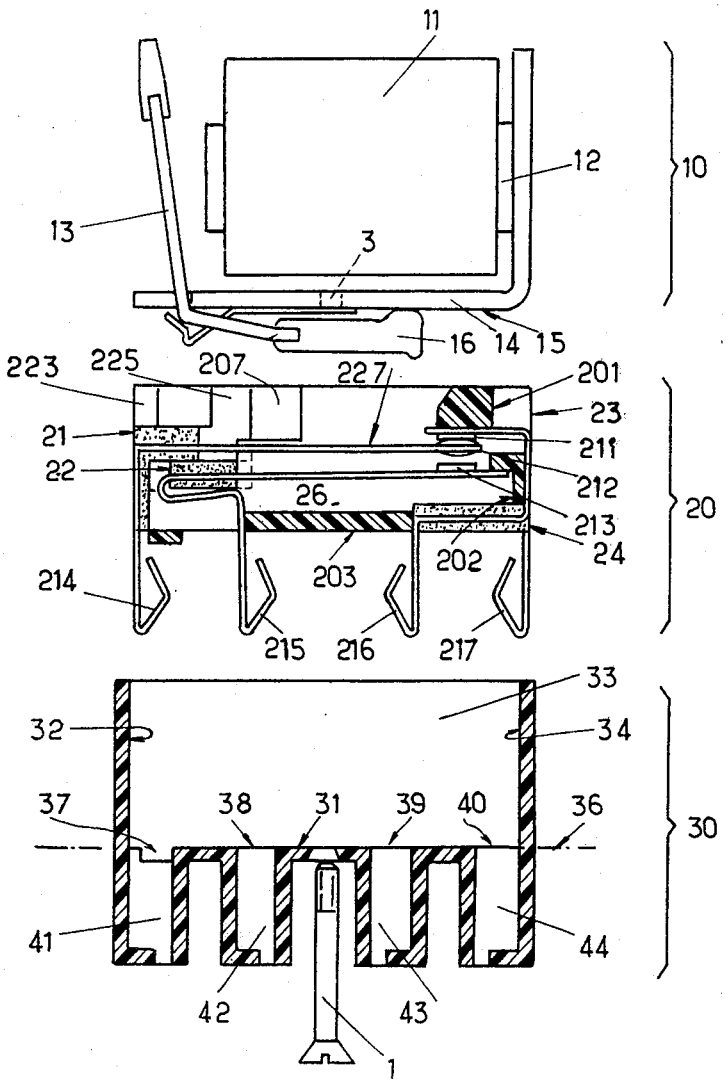

The invention relates to a relay comprising a base for receiving the connecting terminals, an electromagnetic motor for actuating the contacts and means for holding the fixed and mobile contacts, the said means being positioned and maintained in place between the base and the motor by means of a clamping member.

Devices of this type are in particular produced in the form of small relays to be used in automation and control chains.

Thus, for example, relays according to the general description given hereinbefore are known from French Patent 1,527,178; however, in devices of this type it is necessary to assemble a plurality of unit sub-assemblies each having a reduced number of contacts if it is desired to combine within a single box an adequate number of contacts. It is obviously then necessary to provide partitions between two unit sub-assemblies in order to ensure the necessary insulation whilst utilising a larger motor or several juxtaposed motors leading to a large diversity of components which is disadvantageous both regarding the simultaneity of switching operations and as regards manufacture and performance.

Moreover, the fixed or mobile contacts must be fitted separately in recesses provided for this purpose so that the assembly time becomes relatively long. Finally, the type of connecting terminal adopted means that the thicknesses of the blades carrying the contacts must be selected so as to ensure an adequate rigidity of the connecting terminals either by producing them in the form of pluggable or weldable plugs or by associating a set screw therewith without, however, compromising their strength.

Finally, in the device in question the movable blade of the relay is not directly associated with the electromagnetic motor which further complicates the final assembly process whilst the movable contact is fixed by crimping to a connecting terminal which causes a decrease in reliability due to the high mechanical stresses which occur.

The invention therefore proposes to eliminate the disadvantages of the prior art and provide an electromechanical relay wherein measures are taken so that the assembly of the multiple contacts takes place in simple manner, whereby the said contacts are assembled beforehand in order to facilitate their fitting, whereby the necessary measures are taken so that each contact is placed individually in a switching chamber which is insulated from adjacent switching chambers.

A further object of the invention is to use flexible blades for supporting the contacts, thereby bringing about a considerable economy in raw materials. Moreover, the flexibility of these blades is utilised for forming elastic connecting terminals. Measures are also taken so that the geometrical position of the contacts is rigorously observed despite the variations which can occur from the mass production of the flexible blades with the use of cutting, folding and bending processes.

A primary objective of the invention is achieved through the means comprising a set of insulated supports whereby each is integral with a series of flexible blades carrying the fixed or mobile contacts, through the supports being positioned in recesses of an arcing box having the same number of switching chambers as there are fixed and mobile contact systems and through the supports being maintained in their particular recess by walls which are fixed to both the motor and the base.

Figure 2:
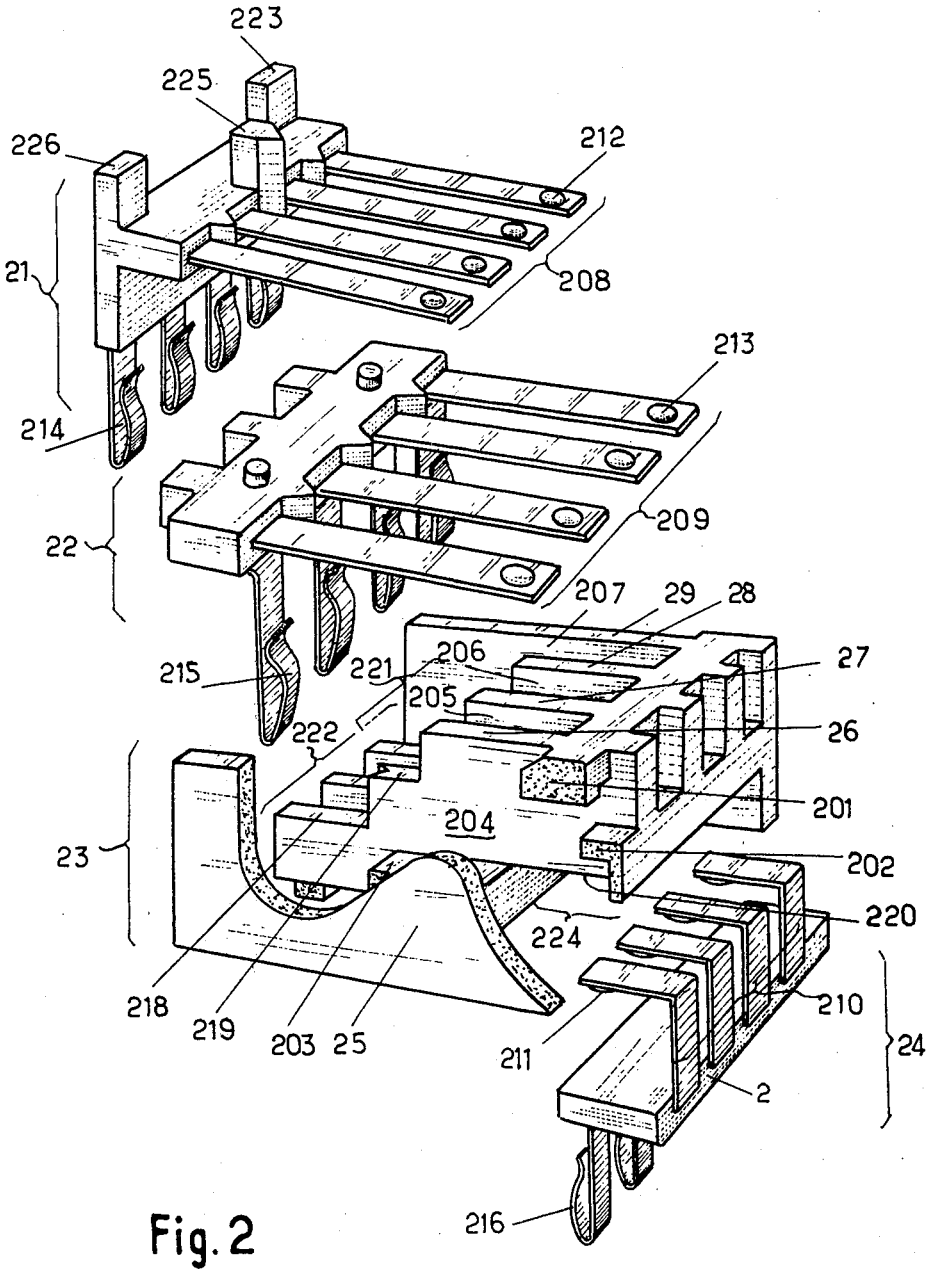
Figure 4:
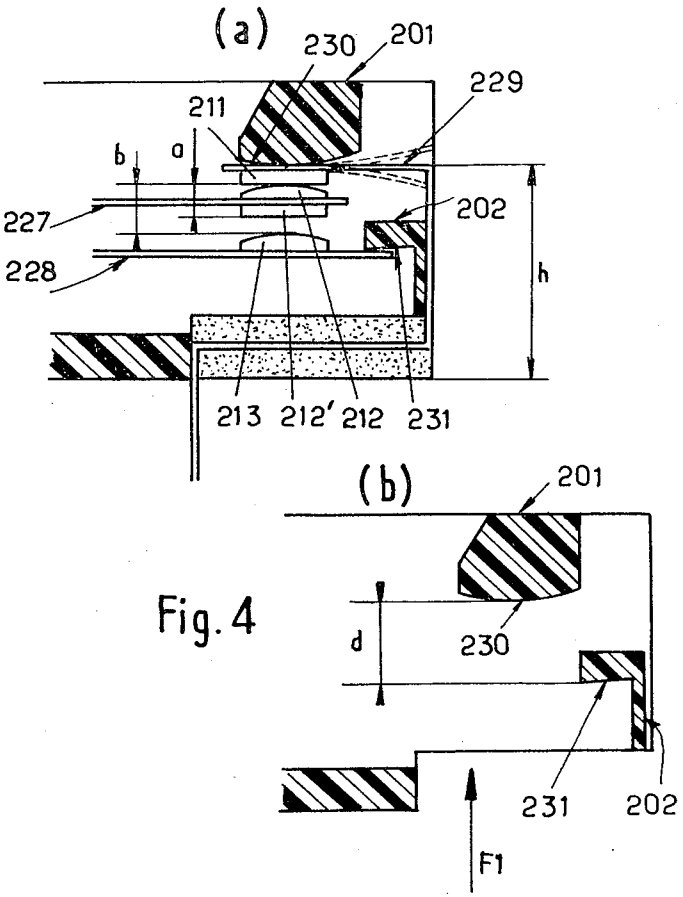
Figure 3:
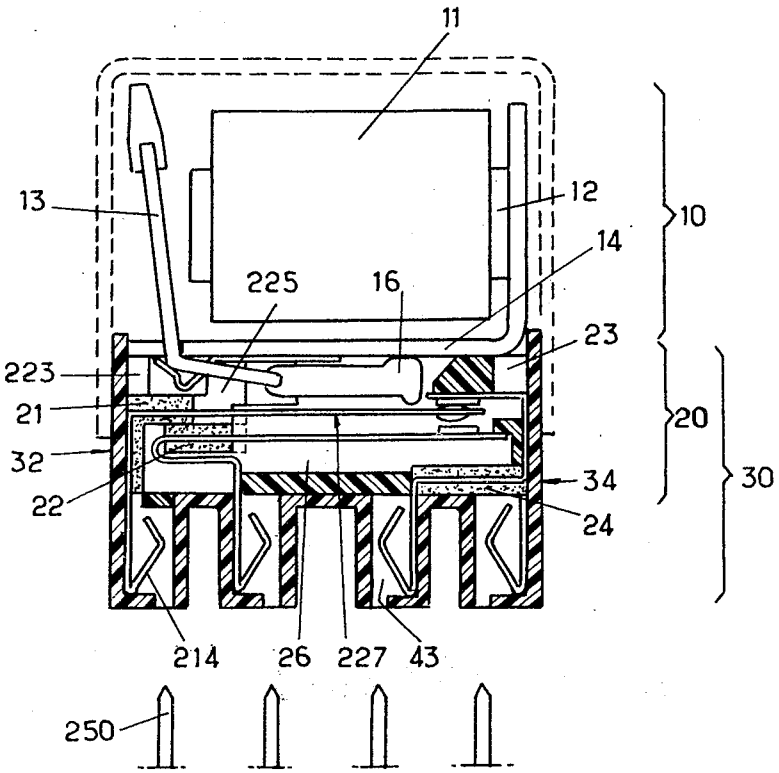

Other measures are taken to ensure the correct geometrical position of the contacts and connecting terminals as will be gathered from the following description, with reference to the drawings wherein show:

FIG. 1, a partial section of the three principal and separated relay elements;

FIG. 2, a perspective view of the main components of the switching member, one of the partitions having been separated from the arcing box;

FIG. 3, a sectional view of the relay according to the invention in its assembled state;

FIGS. 4*a* and 4*b*, two views of the breaking chamber level with the fixed and mobile contacts.

The main components of the relay according to the invention are shown separated from one another in FIG. 1, where 10 is the electromagnetic motor assembly with its coil 11, its fixed core 12, its armature 14 and its movable blade 13 whose end 16 serves to actuate the contactor.

The assembly 20 represents the block whose function is to re-group all the elements necessary for the commutation of the apparatus with the outside. Finally assembly 30 represents the base which on the one hand receives assembly 20 and on the other must be connected to motor 10 for example, with the aid of a screw such as 1. As in the prior art assembly 20 must be gripped between a surface 31 of the base and a surface 15 of armature 14 of the motor by means of a fixing member 1.

If the construction of assembly 20 is examined in greater detail with particular reference to FIG. 2, it can be seen that the latter is formed by assembling four different components 21, 22, 23, 24. Component 23 is an arcing box having a plurality of partitions 25, 26, 27, 28 and 29 which are interconnected by cross-members 201, 202, 203 perpendicular thereto, independent arcing chambers 204, 205, 206, 207 are consequently formed between these partitions. Components 21, 22 and 24 are insulated contact supports formed by a plurality of flexible blades 208, 209, 210 carrying at one of their ends contact discs such as 211, 212, 213 and at their other ends elastic tabs 214, 215, 216 obtained by bending. These series of blades are fixed to the insulated supports 21, 22, 24 by any appropriate means and preferably by re-casting. Arcing box 23 also has in partitions 26, 27, 28 indentations 218, 219, 220 which define the outer partitions 25, 29 recesses 221, 222, 224 whose size is appropriate for receiving supports 21, 22 and 24.

When these supports are assembled on the arcing box they assume the positions indicated in FIG. 1 where the cooperating contacts are located in one and the same arcing chamber. However, at this stage of assembly none of the particular means ensures the permanence of their positioning. The secure maintaining in position of the supports only occurs during the final assembly shown in FIG. 3 through the presence of motor 10, screw 1 and base 30 to be described in greater detail relative to FIG. 1. Base 30 has the general shape of a prismatic receptacle open in the upper portion and constituted by a bottom 31 to which are attached lateral walls 32, 33, 34, 35 whereof only the former are visible. Surface 36 of bottom 31 has a particular number of openings 37, 38, 39, 40 which give access to cavities 41, 42, 43, 44 which receive the elastic tabs 214, 215, 216, 217 of contact element 20. Tab 217 represents one of the terminals for energising the coil. The cavities are open in their lower portion to permit the passage of connecting plugs such as 250 which are brought into engagement with the elastic tabs.

With reference to FIG. 3, it can be seen that recesses 221, 222 and 224 wherein are placed contact supports 21, 22 and 24 are sealed by the presence of surface 15 of armature 14 by the lateral walls 32, 34 and the bottom 31 of the base. The final maintaining in place of the assembly is ensured by the tightening brought about by fixing member 1 in a corresponding opening 3 of the fixed core of the motor.

As can be seen in FIG. 1, the presence of cross-members 201, 202 is utilised for the elastic application thereto of the ends of the flexible blades carrying the fixed contact discs 211 and 213. If it is desired that these cross-members effectively fulfill their function of defining the precise position of the fixed contacts and that the switching gaps are respected, a preferred embodiment of these cross-members shown in FIG. 4*a* should be selected. The flexible blade 227 has on its upper surface a rest contact disc 212 and on its lower surface a working contact disc 212'. These two discs are fitted onto the blade during an automatic rivetting operation which gives their contact surfaces a very accurate gap *a*. If it is desired to obtain a total benefit of the switching times and contact pressures provided, it is necessary for the gap *b* separating the contact surface of the fixed contact discs 211 and 213 also has a comparable precision. A first precaution to be taken for obtaining this precision involves ensuring that the surface 230 of cross-member 201 whereon is supported the flexible blade 229 of the set of contacts 210 carrying contact 211 is separated by a rigorously fixed distance *b* from surface 231 of cross-member 202 whereon is supported the end of flexible blade 228 carrying contact 213. The sought objective is here obtained through these two surfaces 230 and 231 being produced by the same casting located in the direction of arrow F1 and ensuring the regularity of dimension *d* (cf. FIG. 4*b*).

A second precaution consists of giving surface 230 a convex configuration which ensures even if the elastic blade 229 has a height *h* which is greater than or less than its theoretical height (shown by dotted lines in FIG. 4) the practical position of contact disc 211 remains substantially the same. A contact quality is further improved if it is ensured that a curved surface is used for at least one of the two discs 211, 212. This measure is also taken in connection with discs 212' and 213. Note should also be taken of the influence of the configuration of surface 231. However, taking account of the fact that blade 228 is bent prior to assembly, its end always tends to be applied to the edge of surface 231 and the position of disc 213 is substantially only influenced by bending forces which lead to errors of a very limited magnitude.

Moreover, contact support 21 has three small columns 223, 225, 226 shown in FIG. 3 which are directed towards the surface 15 of the motor, being applied thereto during the tightening or clamping operation. Consequently the position of flexible blade 227 is purposely defined relative to the end 16 of movable blade 13 which causes the displacement thereof.

Thus all the measures described hereinbefore tend to ensure the perfect geometrical positioning of all the fixed and movable members which have an important part to play during the switching process, and this is brought about in spite of the fact that assembly 20 is constructed from separately manufactured members. I claim:

1. A relay comprising a base for receiving the connecting terminals, an electromagnetic motor for actuating the contacts and means for holding the fixed and movable contacts, whereby the said means are positioned and held in place between the base and the motor by means of a fixing member, wherein the means comprise a set of insulated supports each integral with a set of flexible blades which carry the fixed or movable contacts, wherein these supports are positioned in recesses of an insulated arcing box which has the same number of switching chambers as there are cooperating contacts and wherein these supports are maintained in their particular recess by walls fixed respectively to the electromagnetic motor and the base.

2. A relay according to claim 1 wherein the ends of the flexible blades opposite to the contacts are bent to form elastic blades and are located in cavities of the base with a view to cooperating with the connecting plugs.

3. A relay according to claim 2, wherein the arcing box comprises parallel partitions placed perpendicular to the plane of the base, being held in place by cross-members which are perpendicular to the partitions, whereby certain of which serve as a support for the ends of the flexible blades carrying the fixed contacts.

4. A relay according to claim 1, wherein the base is shaped like a prismatic box formed by a bottom which is fixed to the lateral walls, whereby the said bottom and the said walls serve to seal at least partially the recesses.

5. A relay according to claim 3, wherein the cross-members whereon are supported the blades carrying the fixed rest and working contacts have two surfaces directed to one side whereby these two surfaces are arranged in such a way that they can be formed by one and the same portion of the casting during the casting operation.

6. A relay according to claim 5, wherein at least one of the said surfaces is convex or has an edge serving as a support for the blades carrying the fixed contacts.

* * * * *